US007277199B2

(12) United States Patent
Swayze et al.

(10) Patent No.: US 7,277,199 B2
(45) Date of Patent: Oct. 2, 2007

(54) IMAGING SYSTEM AND MEDIA SUPPLY FOR USE IN IMAGING SYSTEM

(75) Inventors: Samuel F. Swayze, Fairport, NY (US); David R. Gotham, Sr., Rochester, NY (US); Christopher J. Lundgren, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 962 days.

(21) Appl. No.: 10/376,963

(22) Filed: Feb. 28, 2003

(65) Prior Publication Data

US 2004/0169327 A1 Sep. 2, 2004

(51) Int. Cl.
*B41J 13/10* (2006.01)
*B65H 1/00* (2006.01)

(52) U.S. Cl. ..... 358/1.9; 358/1.12; 358/498; 271/8.1; 271/145; 271/162; 347/104; 347/139

(58) Field of Classification Search ..... 358/1.1, 358/1.9, 1.12, 401, 498, 296; 271/8.1, 9.08, 271/145, 162; 347/104, 139, 218, 262
See application file for complete search history.

(56) References Cited

U.S. PATENT DOCUMENTS 5,287,164 A * 2/1994 Watanabe ..... 399/391
5,695,182 A * 12/1997 Sekine ..... 271/9.09
6,252,654 B1 * 6/2001 Kaya ..... 355/408

OTHER PUBLICATIONS http://h20000.www2.hp.com/bc/docs/support/SupportManual/bpI07288/bpI07288.pdf—downloaded May 19, 2003. www.kodak.com/global/plugins/acrobat/en/service/printers/ppm200/ppm200ug.pdf—downloaded May 19, 2003. ftp://ftp.ita.sel.sony.com/ccpg/vaioaccess/dppsv55.pdf—downloaded May 20, 2003.

* cited by examiner

*Primary Examiner*—Thomas D. Lee

(57) ABSTRACT

A media supply is provided for use in an imaging device having an entry port. The media supply has a housing defining a media storage area to hold media, an opening to receive media, and a device engagement surface shaped for insertion into the entry port A media enclosure is mounted to the housing and is movable between an open position wherein the media storage area can be accessed through the opening and a closed position blocking the opening. Wherein the media storage area, media enclosure, and engagement surface are arranged so that the media enclosure can be moved between the closed position and the open position when the engagement surface is inserted into the entry port.

24 Claims, 11 Drawing Sheets

IMAGING SYSTEM AND MEDIA SUPPLY FOR USE IN IMAGING SYSTEM

FIELD OF THE INVENTION

The present invention relates to imaging devices and more particularly to imaging devices that use media supply trays to supply media for imaging operations.

BACKGROUND OF THE INVENTION

Many types of imaging devices such as thermal printers, inkjet printers, laser printers, scanners, and other like imaging devices receive stored media in the form of cut sheets. Often, such imaging devices have media supply areas that comprise racks, trays or other structures that are positioned to receive media and to properly position the media for use by the imaging device. One example of such imaging device is the Kodak Personal Picture Maker 200 ink jet photo printer sold by the Eastman Kodak Company, Rochester, N.Y. The Personal Picture Maker holds sheet media in a paper support tray that supports the media and positions the sheet media for use. The paper support tray is outside of the printer and has an open configuration to allow a user to freely access the paper in the paper support tray to add, remove, change or otherwise organize the paper.

Other printer types such as the Hewlett Packard Laser Jet 5SI, sold by Hewlett-Packard, Boise, Id. use a combination of removable bins and a paper support tray to store media. The bins are removed from the printer for loading and, after loading, the bins are reinserted into the printer. When a bin is re-inserted, the bin properly orients the media for use by the printer. This allows large volumes of media to be loaded and stored in the printer. For example, such bins are typically adapted to receive 500 or more sheets of media in a single loading operation. This greatly reduces the amount of time required to load and/or reload such printers. However, it is necessary to remove the bins from the printer in order to access the media stored therein such as where it is desired to change or reorder media. Accordingly, printers such as the LaserJet 5SI are often adapted with a separate paper support tray and loading system adapted to receive individual sheets of media. This separate paper support and loading system is used to allow the printer to maintain a single type of media in a tray while being readily adaptable to additional or other forms of media by way of the loading tray. It will be appreciated, however, that the use of such a separate loading tray increases the cost, size and complexity of the printer.

Still other types of printers use media supply cartridges that are fully or partially inserted into the printers. Such cartridges provide many of the advantages of the trays described above. Such cartridges typically use a clamshell type structure having a media holding structure and a separable containment surface that joins to the media holding structure to contain media within the cartridges. This clamshell type configuration allows a user to insert media into the clamshell by separating the containment surface from the media holding surface. However, this separation can only be made when the clamshell is removed from the printer. Accordingly, in such printers, it is not possible to access the media in a cartridge for example to load or change the media in the cartridge while such a clamshell cartridge is in the printer. In some printers, the containment surface is pivotally connected to the media holding structure. However, here too, the clamshell cartridge structure cannot be pivotally opened when the cartridge is in place on the printer.

What is needed therefore, is a media supply and imaging system that can provide the advantages of a cartridge or bin media supply yet also affords a user with the ability to access the media stored therein without requiring the user to remove the media supply re from the imaging device.

SUMMARY OF THE INVENTION

A media supply is provided for use in an imaging device having an entry port. The media supply has a housing defining a media storage area to hold media, an opening to receive media, and a device engagement surface shaped for insertion into the entry port. A media enclosure is mounted to the housing and is movable between an open position wherein the media storage area can be accessed through the opening and a closed position blocking the opening. Wherein the media storage area, media enclosure, and engagement surface are arranged so that the media enclosure can be moved between the closed position and the open position when the engagement surface is inserted into the entry port.

In another aspect of the invention, an imaging system is provided, the imaging system has an imaging device having an entry port and a media supply. The media supply comprises a housing defining a media storage area to hold media, an opening to receive media, and a device engagement surface shaped for insertion into the entry port. A media enclosure is mounted to the housing and is movable between an open position wherein media can be inserted into the media storage area and a closed position blocking the opening. Wherein the media storage area, media enclosure, and engagement surface are arranged so that the media enclosure can be moved between the closed position and the open position when the engagement surface is inserted into the entry port.

In still another aspect of the invention an imaging system is provided. The imaging system comprises a housing means said housing means having an area for storing media and an engagement surface. An enclosure means is provided with the media enclosure means being movable between a position permitting access to media in the housing means and a position preventing access to media in the housing means. An imaging means for performing imaging operations on stored media is provided. The imaging means is adapted to receive the engagement surface of the housing means, to extract stored media from the housing means and to perform imaging operations using the extracted media. Wherein the media enclosure means is movable between the position permitting access to media in the housing means and the position preventing access to media in the housing means when the imaging means receives the housing means.

DETAILED DESCRIPTION OF THE INVENTION

Figure 1:
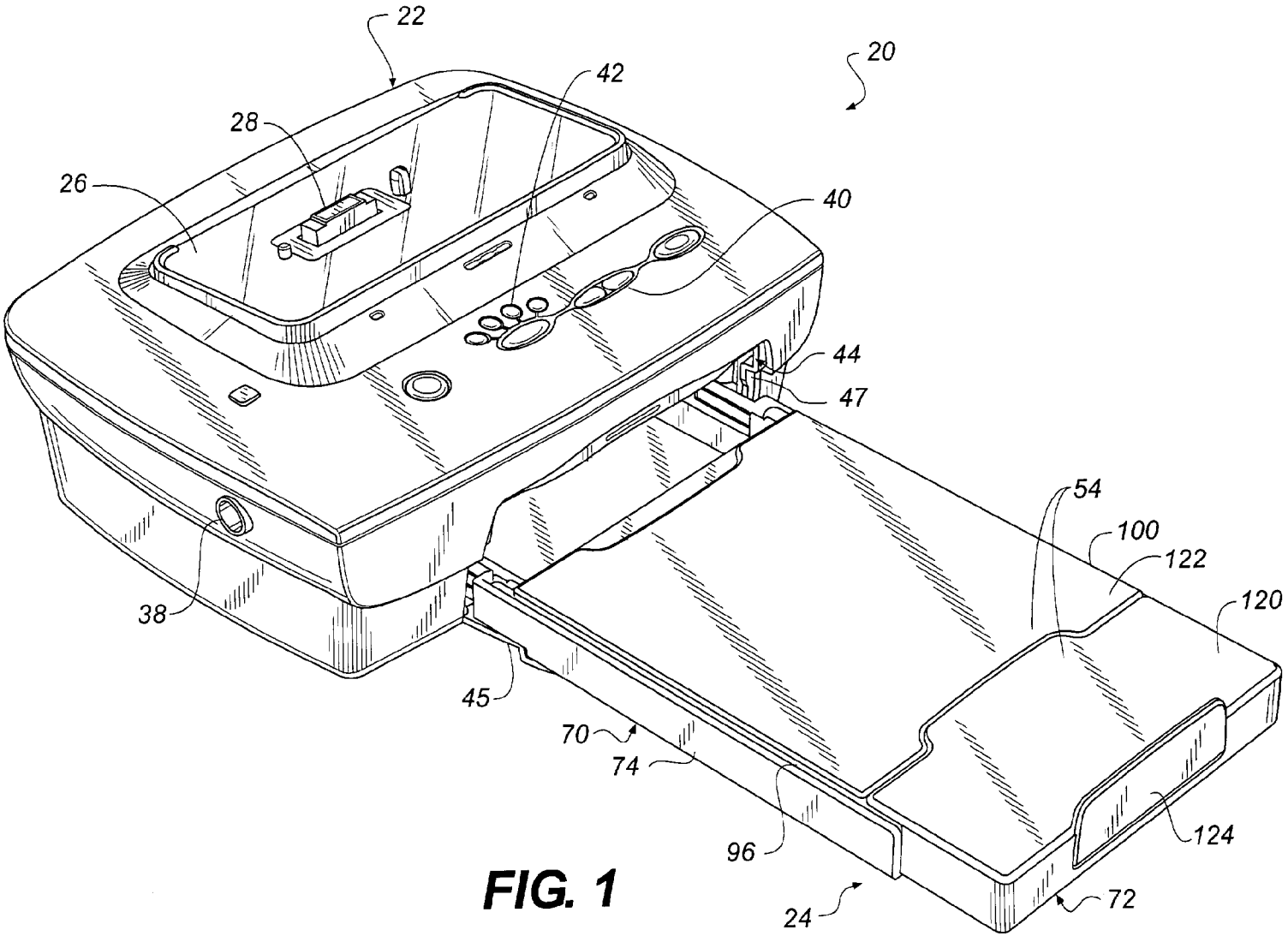
FIG. 1 shows a first embodiment of an imaging system with an imaging device and media supply.
Figure 2:
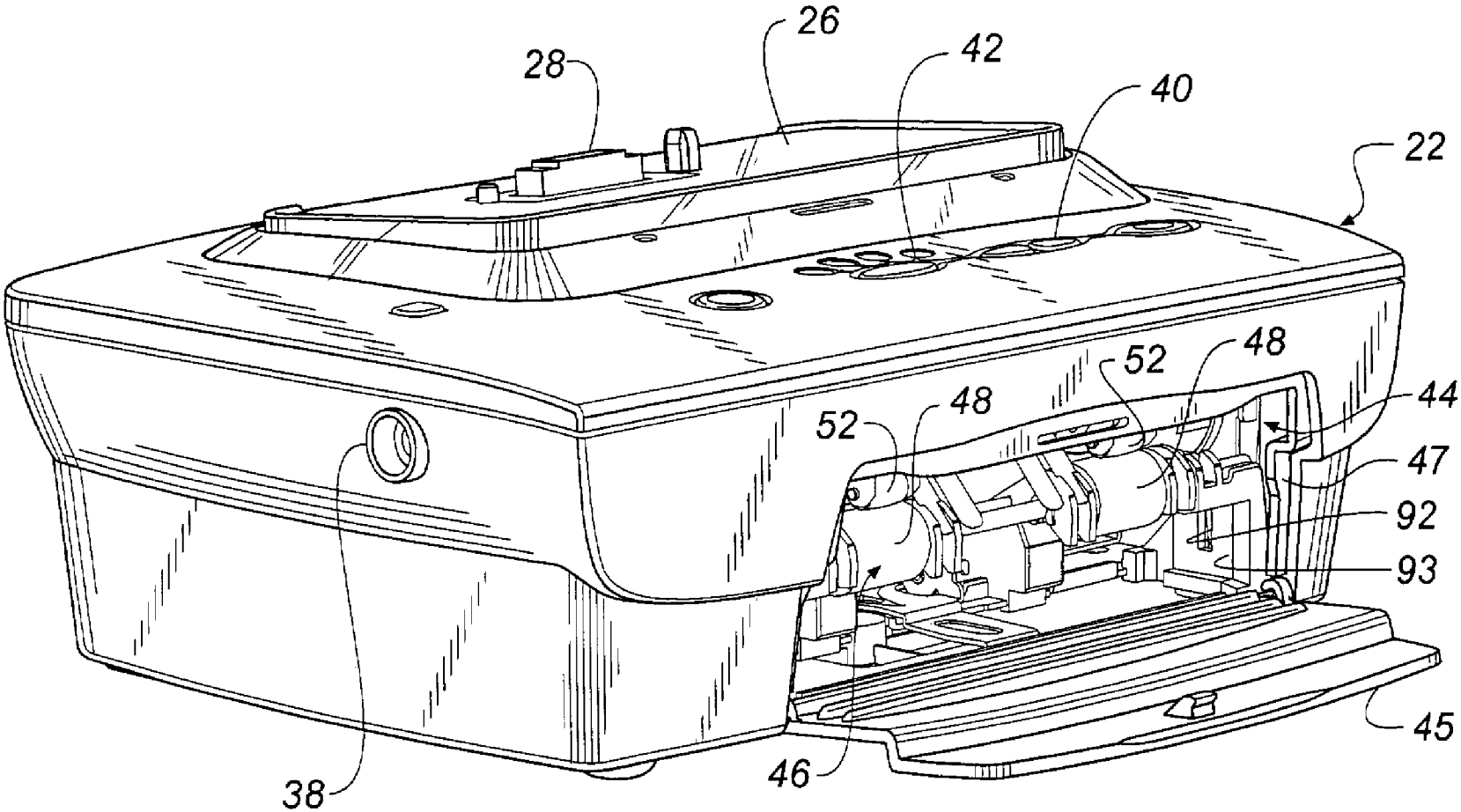
FIG. 2 shows a left front elevation view of the imaging device of FIG. 1.
Figure 3:
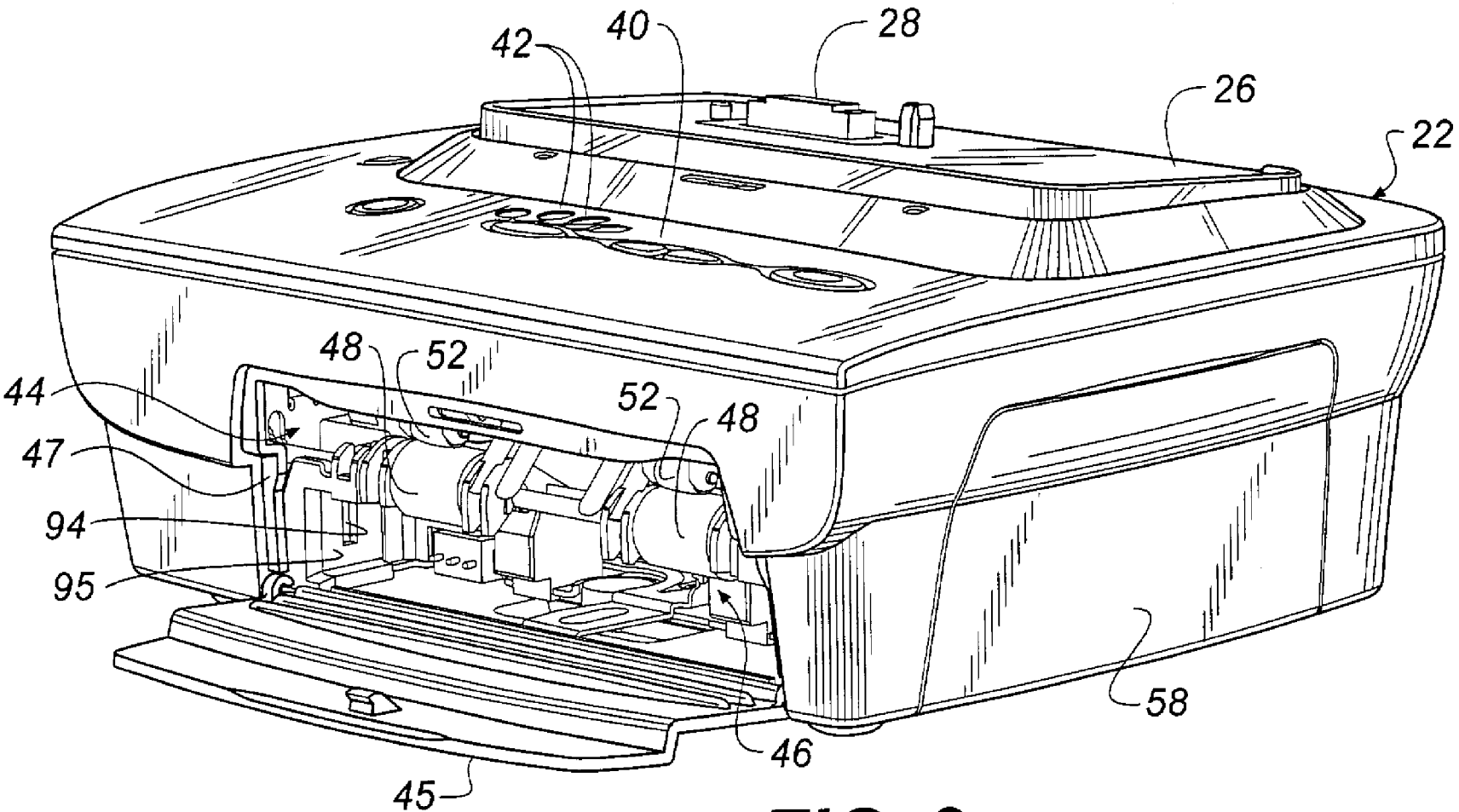
FIG. 3 shows a right front elevation view of imaging device shown in FIGS. 1 and 2.
Figure 4:
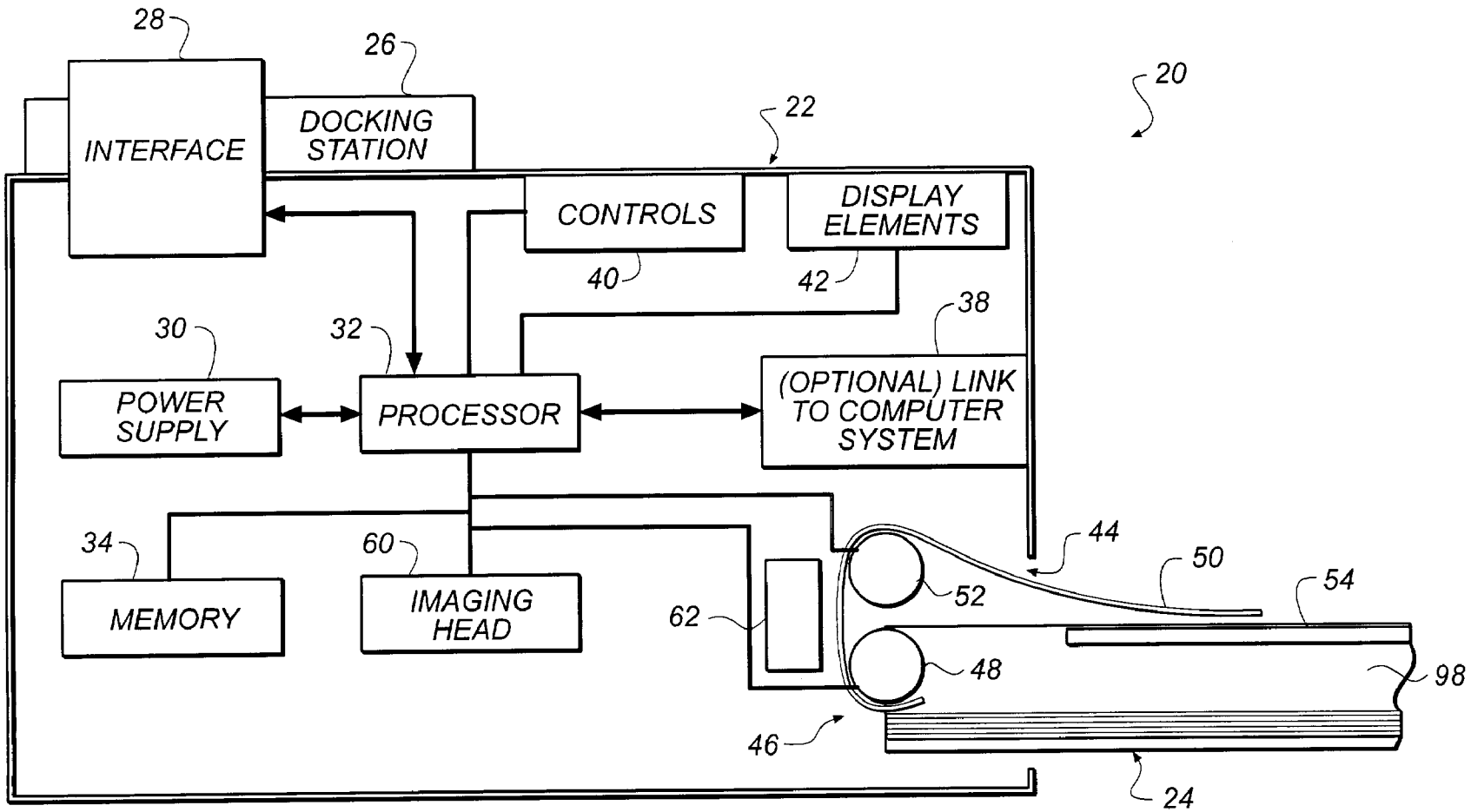
FIG. 4 shows a block diagram of an imaging device of FIGS. 1-3.

FIG. 1 shows a first embodiment of an imaging system 20 in accordance with present invention. As is shown in the embodiment of FIG. 1, imaging system 20 comprises an imaging device 22 and an associated media supply 24. FIGS. 2, 3 and 4 show, respectively a left front elevation view of imaging device 22, a right front elevation view of imaging device 22 and a block diagram illustrating various functional components of imaging device 22. In this embodiment, imaging device 22 has a docking station 26 adapted to receive a device such as a digital still or motion video camera (not shown) having images recorded therein in an electronic memory (not shown). An interface 28 is provided at docking station 26 to engage a co-designed interface area (not shown) on the camera to exchange data with a camera memory. In this way data such as digital images, audio signals, image metadata and control signals can be exchanged between the camera memory and processor 32 of imaging device 22. Processor 32 can act on this data and can also store this data in memory 34. Alternatively, in this embodiment, imaging device 22 can also interface with another device such as a personal computer, personal digital assistant, or other device or a network of electronic devices, by way of link 38. Imaging device 22 also has user controls 40 adapted to receive user input actions and to determine operational instructions therefrom. Display elements 42 provide information about the operational status of imaging device 22. As is also shown in FIG. 4, a power supply 30 is provided and provides energy to operate imaging device 22.

As is shown in FIGS. 1-4, imaging device 22 has an entry port 44 for receiving media supply 24. An optional entry port door 45 is also shown in the embodiment of FIGS. 1-4 to close entry port 44 when a media supply 24 is not installed in entry port 44 and to partially support media supply 24 when media supply is installed in entry port 44. A motorized roller system 46 having a set of bottom rollers 48 adapted to extract media 50 from media supply 24 which passes media 50 to a co-designed set of top rollers 52 adapted to move media 50 out of imaging device 22 and onto a top surface 54 of media supply 24. Between bottom rollers 48 and top rollers 52 media 50 is exposed to an imaging head 60. In the embodiment of FIGS. 1-4, the imaging head 60 comprises a thermal printer head that applies heat to a donor material 62 disposed between imaging head 60 and media 50. By variably applying heat to donor media 62, colorants and/or dyes are transferred from donor material 62 to media 50 to form an image. In this way, images can be formed on media 50. It will be appreciated that, other forms of printing can be used such as inkjet or laser printing, and that where such other forms are used, imaging head 60 will be adapted for such form of printing. Such other forms of printing are conventional and may or may not use a donor material 62 in forming an image. Donor materials 62 such as donor sheets, inks and other donor material can be received by way of donor material supply port 56 and donor supply door 58.

Figure 5:
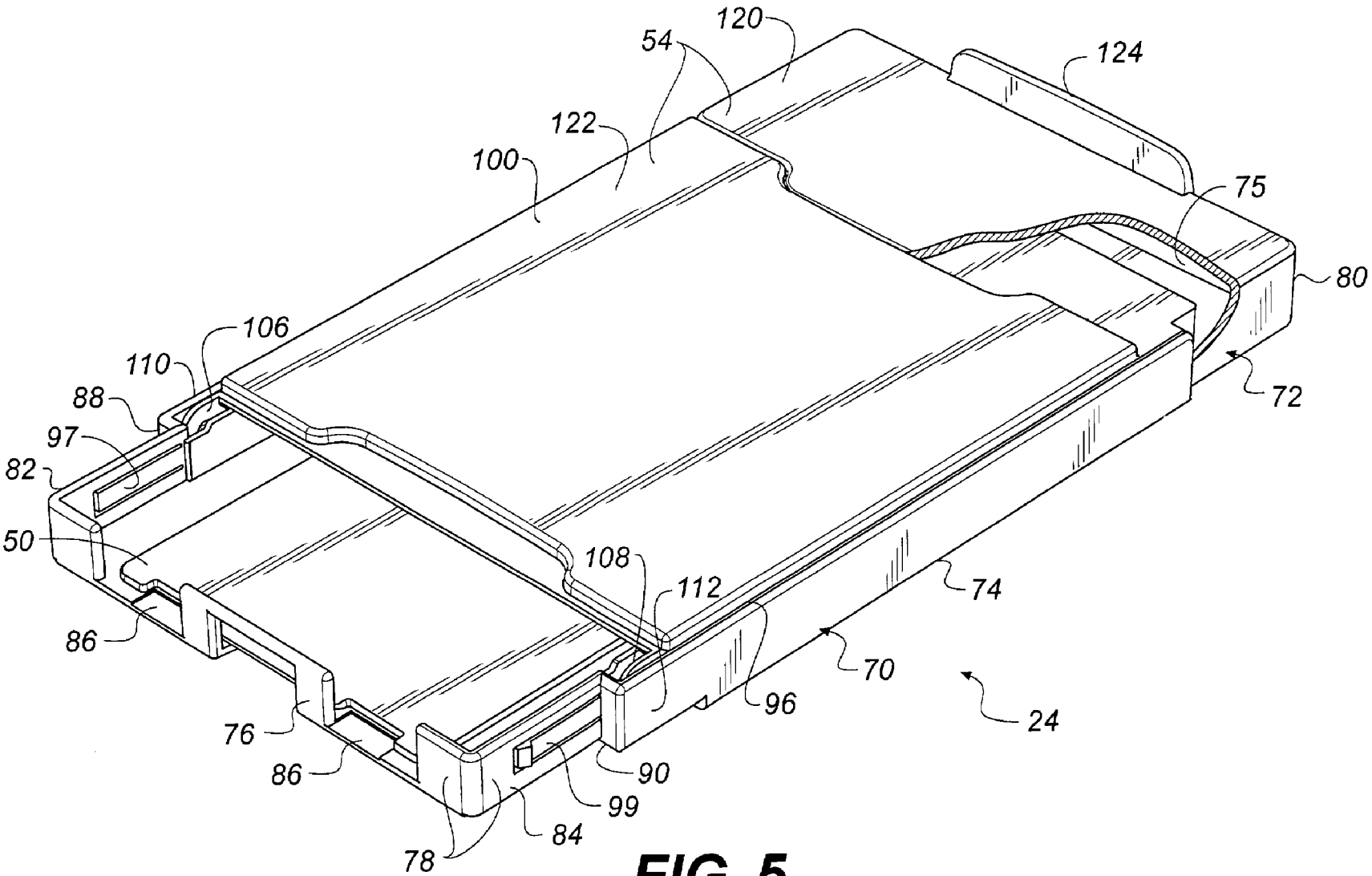
FIG. 5 shows a view of one embodiment of FIGS. 1-4.

FIG. 5 shows an exterior view of media supply 24 shown in FIGS. 1 and 4 in greater detail. As is shown in FIG. 5, media supply 24 has a first section 70 and an optional second section 72 attached thereto. First section 70 comprises a housing 74 having an engagement end 76 with an engagement surface 78 formed thereon. First section 72 also comprises a distal end 80 opposite to engagement end 76.

Engagement surface 78 is shaped to be inserted into entry port 44 of imaging device 22. The shape of engagement surface to 78 is adapted to conform to the shape of entry port 44. In the embodiment shown in FIGS. 1-5, entry port 44 comprises a shoulder portion 47 positioned at the periphery of entry port 44 and engagement surface 78 is adapted to cooperate with shoulder portion 44. This cooperation can be used to help establish the lateral alignment and/or longitudinal positioning of the media supply 50 relative to imaging device 22. In this regard, engagement surface 78 provides lateral engagement surfaces 82 and 84 to engage shoulder portion 47 bi-laterally. This helps to ensure that media supply 50 is laterally aligned with entry port 44 and can also be used to help ensure that roller receiving openings 86 of media supply 24 are aligned with bottom rollers 48 when media supply 24 is inserted into entry port 44.

Engagement surface 78 is also the shaped to co-operate with shoulder 47 to provide longitudinal positioning of media supply 24 relative to imaging device 22. This helps to protect imaging device 22 from damage that could the caused by over insertion of media supply 24 and also helps to ensure that bottom rollers 40 are properly aligned with media 50 when media supply train 24 is inserted into imaging device 22. To accomplish this, engagement surface 78 also provides stopping surfaces 88 and 90 that extend from lateral engagement surfaces 82 and 84 so that as media supply 24 is longitudinally inserted into entry port 44 of imaging device 22, stopping surfaces 88 and 90 longitudinally engage shoulder 47 to define the extent to which media supply 24 can project into entry port 44. In this way, it is also possible to define with precision, which portions of media supply 24 are within imaging device 22 and which portions of media supply 24 are outside of imaging device 22 when media supply 24 is installed in imaging device 22.

Interlocking features can also optionally be provided to help secure media supply 22 to imaging device 22. One embodiment of these interlocking features is shown in FIGS. 2, 3 and 5. FIGS. 2 and 3 show locking depressions 92 and 94 formed in surfaces 93 and 95 in entry port 44. Referring again FIG. 5, media supply 24 is shown having an engagement surface 78 with resilient tab structures 96 and 98. Tab structures 97 and 99 are generally identical with an inside portion of tab structure 97 and an outside portion of tab 99 shown in FIG. 5. It will be appreciated that in the embodiment of FIG. 5, the outer portion of tab structure 97 generally corresponds to the outer portion of tab structure 98 and that the inner portion of tab structure 99 generally corresponds to the inner portion of tab structure 97 as shown in FIG. 5. Tab structures 97 and 99 are adapted to resiliently deform inwardly when inserted along surfaces 93 and 95 to project into locking depressions 92 and 94 when media supply 24 is properly inserted into entry port 44. This helps to secure media supply 24 in entry port 44 during imaging operations. Other similar arrangements can be used.

In the embodiment shown in FIGS. 1-5, housing 74 defines an opening 96 into which a media 50 can be inserted and a storage area 98 proximate to opening 96 for storing media 50. A media enclosure 100 is positioned in opening 96. This helps to secure media 50 in storage area 98 and, can be adapted to protect media 50 from environmental or mechanical damage. In the embodiment shown, media enclosure 100 comprises an outer surface 104 and pivot portions 106 and 108 that are joined to co-designed pivot anchors 110 and 112 in housing 74. This pivotal arrangement allows media enclosure to move between a closed position shown in FIGS. 1 and 5 and an open position. As is shown in FIG. 1, when media supply 50 is inserted into imaging device 22, during operation, media enclosure 84 is typically left in a closed position. This minimizes the overall profile of media supply 24. Other mechanisms for joining media enclosure 84 to housing 70 can be used, some of which, will be shown and described in greater detail below.

In this embodiment, the point at which media enclosure 100 is pivotally connected to housing 74 is separated from the engagement end 58 of housing 56 by stopping surfaces 88 and 90. The physical arrangement of shoulder 47, stopping surfaces 88 and 90 and the connections between media enclosure 100 and housing 74 are arranged so that the point of connection between housing 74 and enclosure 100 occurs outside of imaging device 22 when media supply 24 is inserted into entry port 44.

Figure 6:
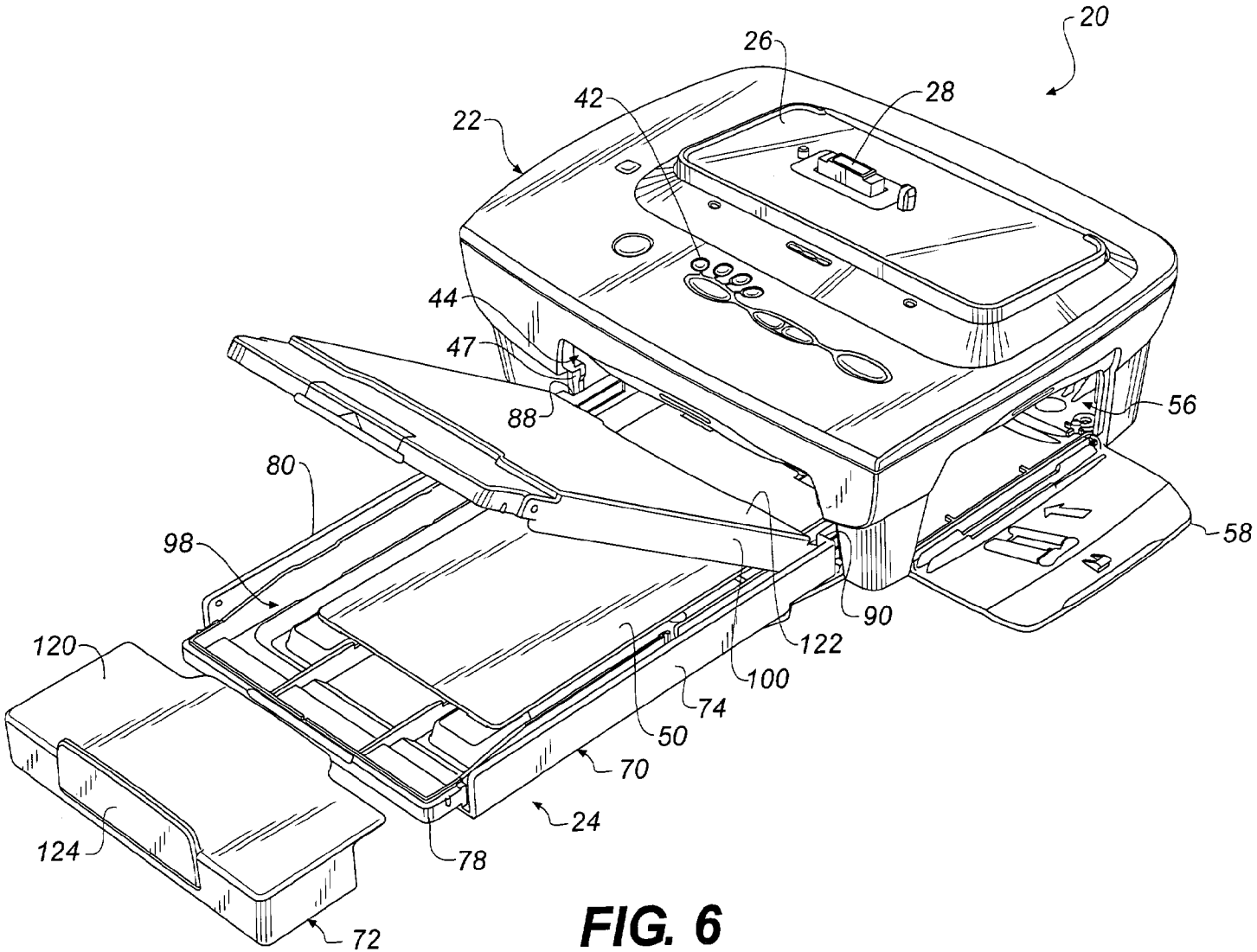
FIG. 6 shows a view of the imaging system with a media supply installed in the imaging device and the media supply in an open position.

FIG. 6 shows the embodiment FIGS. 1-5 with the media supply 24 installed in entry port 44 and enclosure 100 positioned at an open position that permits access to media 50 stored in media supply chamber 98 of housing 72. As is shown in FIG. 4, media enclosure 100 is moved from the closed position shown in FIG. 1 to the open position shown in FIG. 6 by pivotal movement of media enclosure 100 about the point of pivotal engagement between housing 74 and media enclosure 100. Because this point of pivotal engagement is outside of entry port 44, when media supply 24 is inserted into imaging device 22, media enclosure 100 can be pivotally adjusted between the closed an opening position without requiring removal of media supply 24 from imaging device 22. This permits a user of imaging device 22 to make adjustments to the type, composition, and arrangement of media 50 in supply chamber 98 without requiring media supply 24 to be removed from entry port 44 of imaging device 22. This also permits use of media supply 24 to perform the functions of both a media supply bin or cartridge and the functions of a media support tray as described above. This permits a significant reduction in the cost and overall profile of the imaging device 22 used in an imaging system 20.

In the embodiment shown in FIGS. 1-6, media supply 50 is shown as also comprising an optional second section 72. As is shown in FIGS. 1-6, second section 72 is joined to housing 74 at distal end 80. In the embodiment shown, second section 72 defines an interior chamber 75 sized and shaped to engage distal end 80 of housing 74 and, optionally both of distal end 80 and media enclosure 84. This can be used, for example, to secure or provide additional security to hold enclosure 84 during imaging operations. In the embodiment shown in FIG. 1-6, second section 72 also comprises a top surface 120 shaped to cooperate with a top surface 122 of enclosure 100 to define top surface 54 of media supply 24. As is discussed above, in the embodiment shown in FIGS. 1-7, top surface 54 of media supply 24 receives media 50 that is passed out of entry port 44, said media 74 typically been passed or projected out of entry port 44 after media 50 has been used for imaging purposes by imaging device 22. A media positioning feature 124 is shown on top surface 120 of second section 72. The media positioning feature 124 is shaped to receive media 50. In this embodiment, media positioning feature 124 provides a stop to ensure that media 50 passed out of entry port 44 is contained within a particular longitudinal space. However, media positioning feature 124 can be a component of either of first section 70 or second section 72 and can also be used, for example to help confine the projected media 74 within lateral space.

Figure 7:
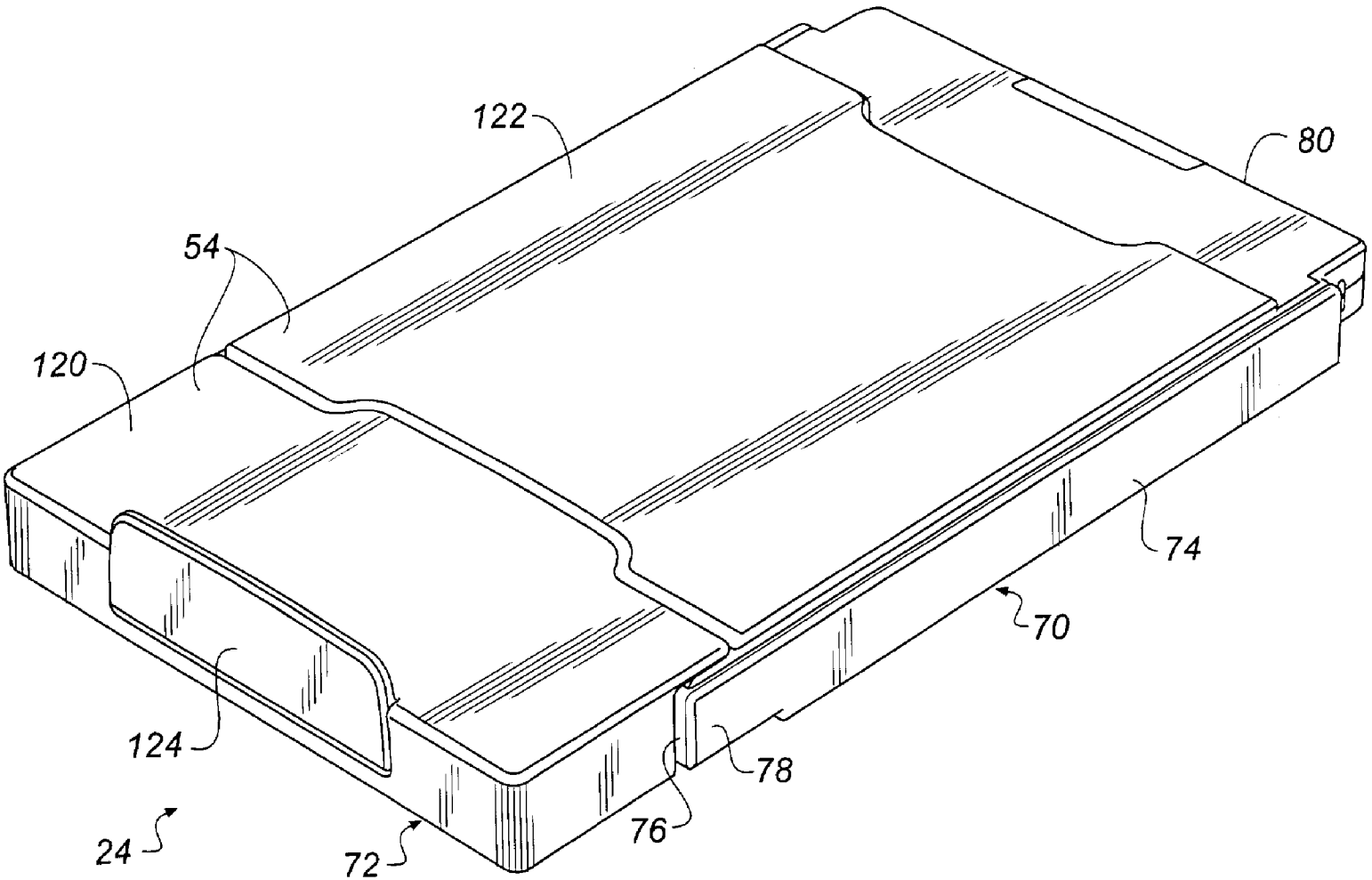
FIG. 7 shows a view of the media supply with a second section of the media supply joined to an engagement surface of a first section.

In another embodiment of the present invention, interior chamber 75 is also sized and shaped to be joined to engagement surface 78 of housing 74. One example of this is shown in FIG. 7. As shown in FIG. 7, when media supply 50 is removed from imaging device 22, second portion 72 can be joined to engagement surface 78 of media supply 50 to protect engagement surface 78 and media 50.

As is also shown in the embodiment of FIG. 7, second portion 72 can be defined in a way that forms a sealed enclosure about engagement surface 78 or that cooperates with engagement surface 78 to form a seal when closed. This creates a media supply 24 that is readily adaptable to hold media in a sealed condition between usages while yet providing an easily accessible system for containing such media and preparing the media for use. Such a sealed media supply 24 can be particularly useful in extending the useful life of a media 50 that has evanescent qualities, such as media 50 having particular coatings, photosensitivity, pressure sensitivity or thermal sensitivity and/or any other environmentally reactive properties or that can otherwise usefully be contained within a sealed media supply 24.

Figure 8A:
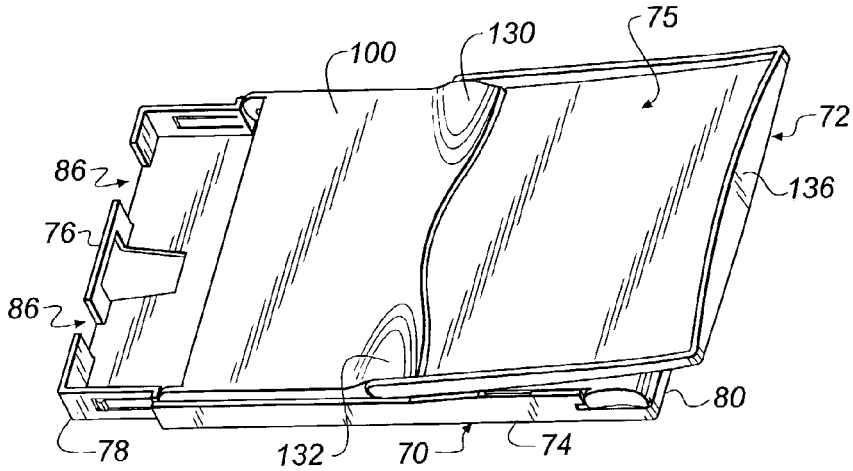
FIGS. 8*a*-8*e* show views of another embodiment of a media supply.
Figure 8B:
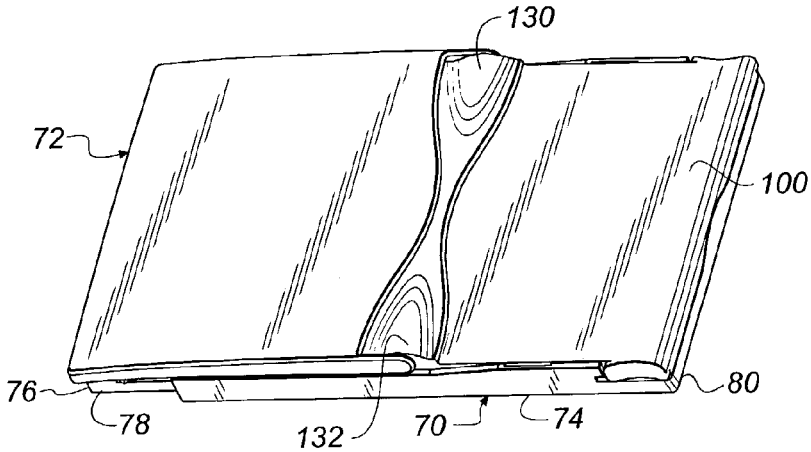
Figure 8C:
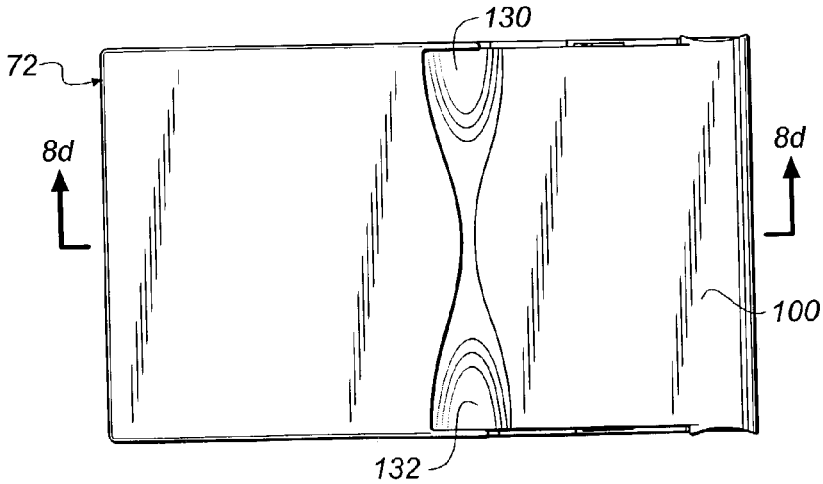
Figure 8D:
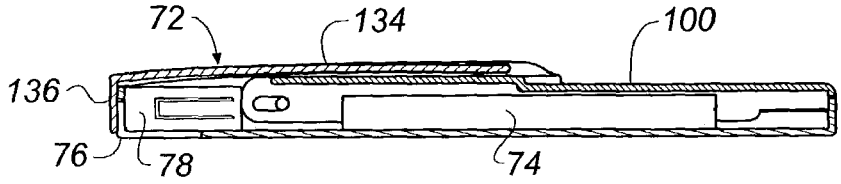
Figure 8E:
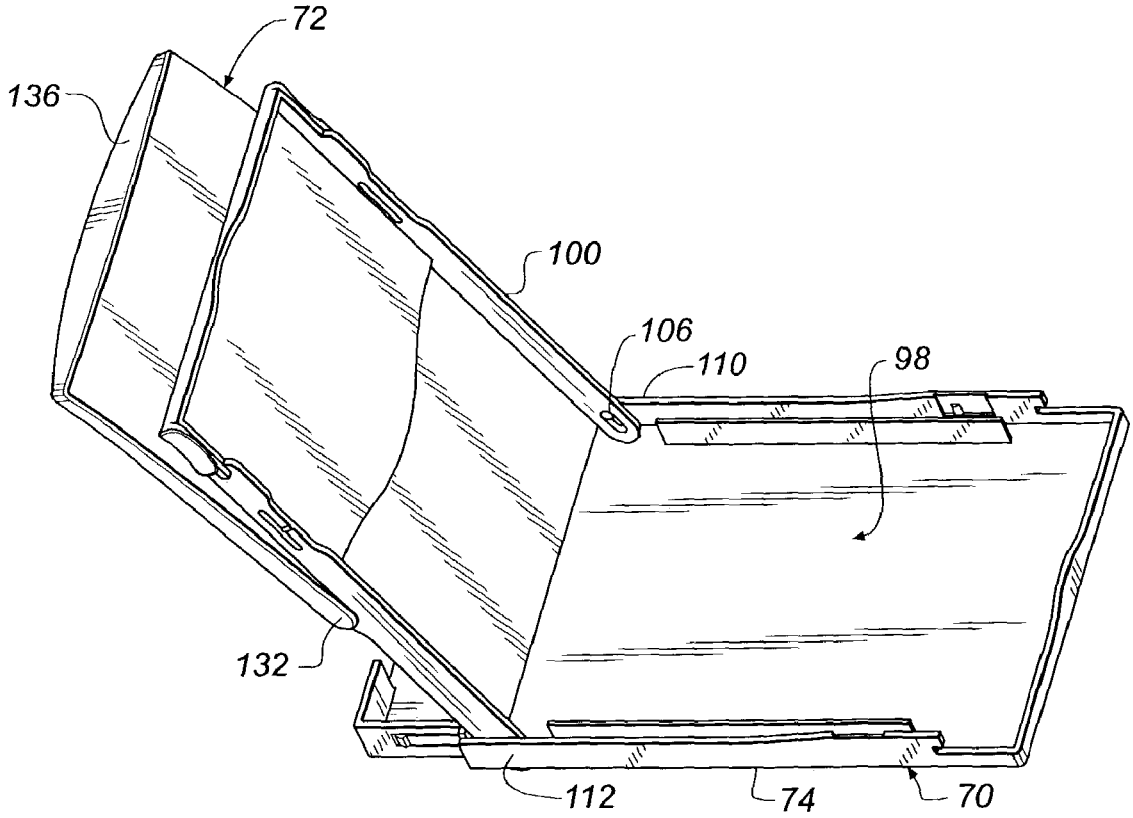

FIGS. 8*a*-8*e* show an alternative embodiment of media supply 24 of the present invention having a media enclosure 100 with a second section 72 joined thereto. FIGS. 8*a* and 8*b* show media enclosure 100 in a closed position. In this position opening 90 is closed by the media enclosure. However, in this embodiment second section 72 is joined by way of a pivotal engagements 130 and 132 to top surface 122 of media enclosure 100. When second section 72 is positioned as shown in FIG. 8*a*, second section 72 has a surface 134 and walls 136 defining an interior cavity 75. Interior cavity 75 is defined to form a part of top surface 58 of media supply 24 and to receive media 50 projected from imaging device 22 when in the position shown in FIG. 8*a*. However, surface 134 and walls 136 are also define interior cavity 75 in away that conforms to engagement surface 78. The arrangement of pivotal engagements 130 and 132, surface 134 and walls 136 is defined so that pivotal movement of second portion 72 from the position shown in FIG. 8*a* to the position shown in FIG. 8*b* closes roller receiving openings 86 in engagement end 78. FIGS. 8*b* and 8*c* show, respectively a top and a cross section view of an embodiment of media supply 24 with second portion 72 positioned in the position shown in FIG. 8*b*. As is shown in FIG. 8*e*, media enclosure 100 is pivotally mounted to housing 74 and housing 74 is defined in the manner described above and so that media enclosure 100 can be moved to between a closed position and an open position while media supply 24 is installed in an imaging device.

Figure 9A:
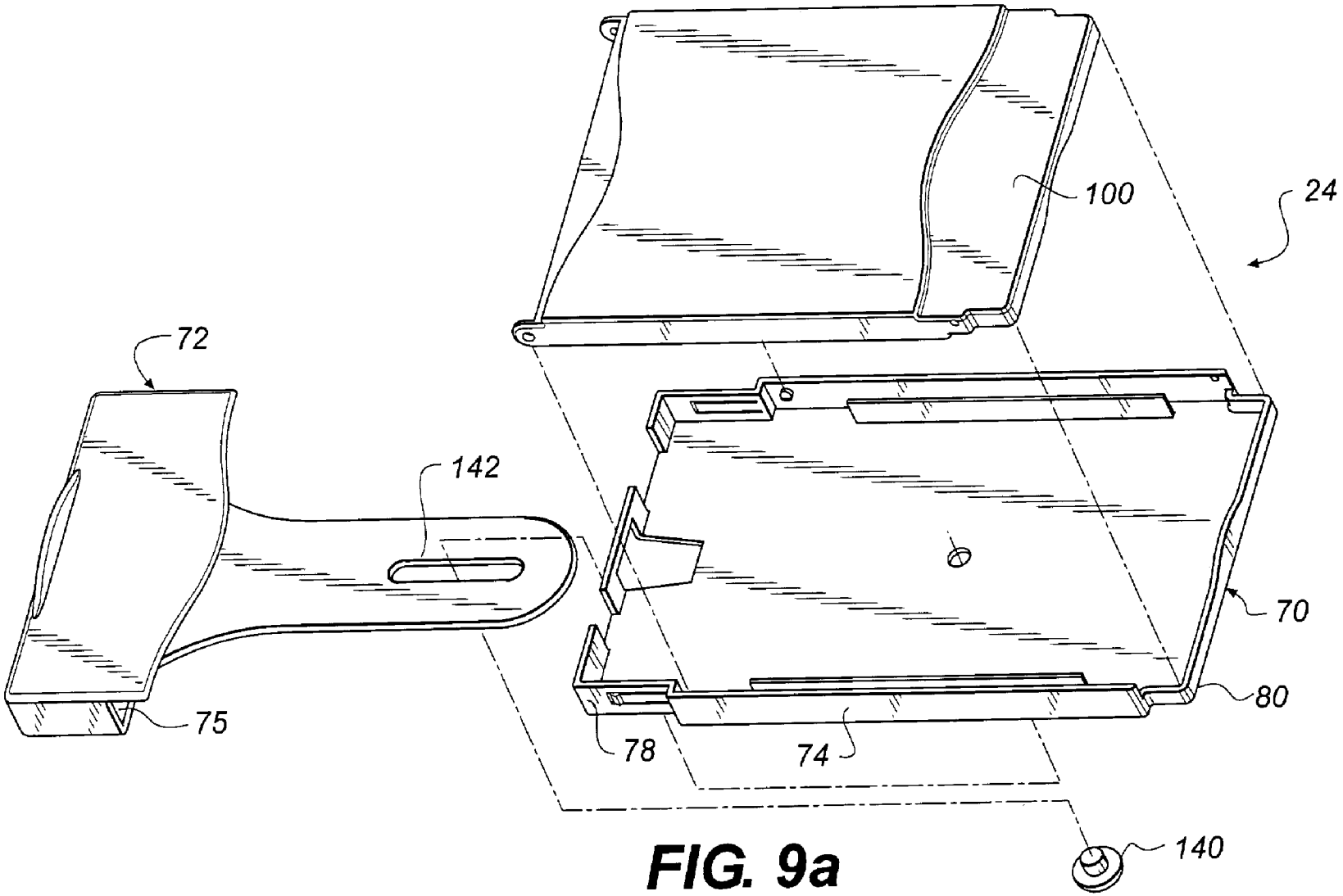
FIGS. 9*a*-9*d* show views of another embodiment of a media supply.
Figure 9B:
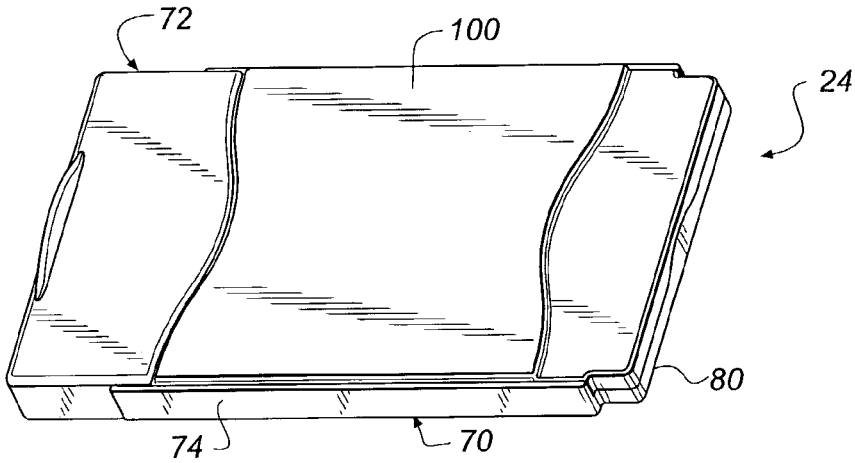
Figure 9C:
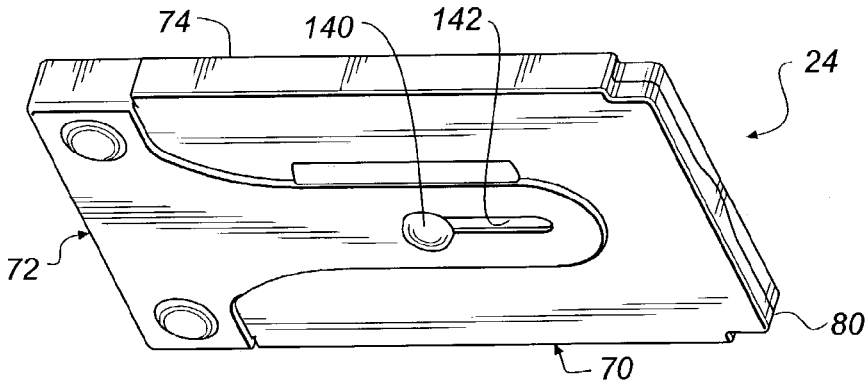
Figure 9D:
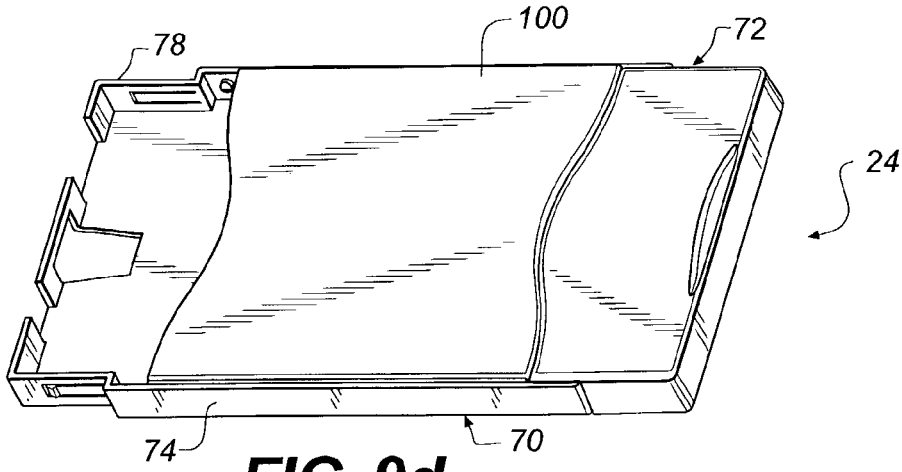

FIGS. 9*a*-9*d* show still another embodiment of a media supply in accordance with the present invention. FIG. 9*a* shows an exploded view of this embodiment in a closed position, while FIGS. 9*b* and 9*c* show a top left front perspective view and a bottom left front perspective view of this embodiment in a closed position. As is shown in this embodiment, media supply 24 comprises a housing 74 and media enclosure 100 as described above. However, in this embodiment second section 72 is pivotally connected to housing 74 by way of pivot 140. Second section 72 has an interior chamber 75 that is adapted to be joined to either of engagement surface 78 on engagement end 76 of housing 74 as shown in FIG. 9*b* and 9*c* or to distal end 80 as is shown in FIG. 9*d*. As is shown in FIGS. 9*a*-9*c* second section 72 has a slide slot 142 though which pivot 140 is connected. This permits a user to move second section 72 longitudinally as well as pivotally about pivot 140. To move second section 74 from a position wherein interior chamber 75 engages engagement surface 78 to a position wherein interior chamber 75 engages distal end 80, a user slides second section 72 along slide slot 142 to disengage interior chamber 75 from engagement surface 78. Once that this is disengaged, second section 74 can be pivotally moved about pivot 140 to a position confronting distal end 80 of housing 74 and/or media enclosure 100 the user can slide second section 74 along slide slot 140 to engage distal end 80 and/or media enclosure 100 with interior chamber 75 of second section 74.

It will be appreciated that the foregoing discussion has been directed to an imaging device comprising a printer. However, in alternate embodiments, imaging device 22 can comprise any of a inkjet printer, laser jet printer, a pressure applying printer adapted to form images on a pressure sensitive medium, an optical scanner, or laser scanner, or any other imaging reading or forming device adapted to receive media 50 in form that can be stored in a media supply such as media supply 24. It will also be appreciated that while the above described embodiments show a media enclosure 100 that is joined to housing 74 using pivotal arrangements, other arrangements are possible. For example, in alternative embodiments, media enclosure 100 can be slidably mounted to the housing 74 for movement between the open position and the closed position. In still another alternative of this type, media enclosure 100 can be formed of a flexible material that is joined to housing 74 to block the opening to define a closed position and that can be separated from the opening to define an open position.

The invention has been described in detail with particular reference to certain preferred embodiments thereof, but it will be understood that variations and modifications can be effected within the spirit and scope of the invention.

PARTS LIST

20 imaging system
22 imaging device
24 media supply
26 docking station
28 interface
30 power supply
32 processor
34 memory
38 link
40 user controls
42 display elements
44 entry port
45 entry port door
46 roller system
47 shoulder portion
48 bottom rollers
50 media
52 top rollers
54 top surface
56 donor material supply port
58 donor supply door
60 imaging head
62 donor material
70 first section
72 second section
74 housing
75 interior chamber
76 engagement end
78 engagement surface
80 distal end
82 engagement surface
84 engagement surface
86 roller receiving openings
88 stopping surface
90 stopping surface
92 locking depression
93 surface
94 locking depression
95 surface
96 opening
97 tab structure
98 storage area
99 tab structure
100 media enclosure
104 outer surface
106 pivot portion
108 pivot portion
110 pivot anchor
112 pivot anchor
120 top surface second section
122 top surface media enclosure
124 media positioning feature
130 pivotal engagement
132 pivotal engagement
134 surface
136 wall
140 pivot
142 slide slot in second section

What is claimed is:

1. A media supply for use in an imaging device having an entry port, the media supply comprising:

a housing defining a media storage area to hold media, an opening to receive media, and a device engagement surface shaped for insertion into the entry port; and a media enclosure mounted to the housing and moveable between an open position wherein the media storage area can be accessed through the opening and a closed position blocking the opening;

wherein the media storage area, media enclosure, and engagement surface are arranged so that the media enclosure can be moved between the closed position and the open position when the engagement surface is inserted into the media supply entry port; and wherein the entry port comprises a shoulder surface and wherein the engagement surface comprises a stopping surface adapted to engage the shoulder surface to limit extent to which media supply is inserted into the imaging device; and wherein the media enclosure is mounted to the housing at a position that is separated from the shoulder so that the media enclosure can be moved from the closed position to the open position when the media supply is inserted into the entry port of the imaging device.

2. The media supply of claim 1, wherein at least one of the housing and enclosure define media positioning features to position projected media.

3. A media supply for use in an imaging device having an entry port, the media supply comprising:

a housing defining a media storage area to hold media, an opening to receive media, and a device engagement surface shared for insertion into the entry port; and a media enclosure mounted to the housing and moveable between an open position wherein the media storage area can be accessed through the opening and a closed position blocking the opening;

wherein the media storage area, media enclosure, and engagement surface are arranged so that the media enclosure can be moved between the closed position and the open position when the engagement surface is inserted into the media supply entry port; and wherein the imaging system removes media from the media supply and projects the removed media from a defined area above the media supply and wherein at least one of the housing and the media enclosure is located on a top surface of the media supply and shaped to receive the projected media.

4. The media supply of claim 3, wherein the media enclosure closes the opening when the media enclosure is in the closed position.

5. The media supply of claim 3, wherein the media enclosure seals the opening when the media enclosure is in the closed position.

6. The media supply of claim 3, wherein the media enclosure is pivotally mounted to the housing for pivotal movement between the open position and the closed position.

7. The media supply of claim 3, wherein the media enclosure is slidably mounted to the housing for movement between the open position and the closed position.

8. The media supply of claim 3, wherein the media enclosure is formed of a flexible material that can be positioned to block the opening to define a closed position and that can be separated from the opening to define an open position.

9. The media supply of claim 3, wherein the media supply comprises a first section having an engagement end with an engagement surface and a distal end, and a second end joined to the first section.

10. The media supply of claim 9, wherein the second section has an interior cavity conforming to the distal end so that the second section can be joined to the distal end when the engagement surface is inserted in the entry port.

11. The media supply of claim 9, wherein the second section has an interior cavity conforming to the engagement surface so that the second section can be joined to the engagement end when the engagement surface is not inserted in the entry port.

12. The media supply of claim 9, wherein the imaging system removes media from the media supply and projects the removed media onto the media supply and wherein the second section has at least one surface adapted receive at least a part of the projected media.

13. The media supply of claim 9, wherein the second section is joined to the first section for joined movement between a position engaging the engagement end of the first section and a position engaging the distal end of the first section.

14. The media supply of claim 13, wherein the second part forms a seal when the second part engages at least one of the ends of the first section.

15. An imaging system comprising:

an imaging device having an entry port;

a media supply comprising a housing defining a media storage area to hold media, an opening to receive media, and a device engagement surface shaped for insertion into the entry port; and a media enclosure mounted to the housing and movable between an open position wherein the media storage area can be accessed through the opening and a closed position blocking the opening;

wherein the media storage area, media enclosure, and engagement surface are arranged so that the media enclosure can be moved between the closed position and the open position when the engagement surface is inserted into the media supply entry port, and so that media can be drawn from the storage area by the imaging device when the medium enclosure is in either of the open position or the closed position.

16. The imaging system of claim 15, wherein the media enclosure closes the opening when the media enclosure is in the closed position.

17. The imaging system of claim 15, wherein the media enclosure seals the opening when the media enclosure is in the closed position.

18. The imaging system of claim 15, wherein the media enclosure is pivotally mounted to the housing for pivotal movement between the open position and the closed position.

19. The imaging system of claim 15, wherein the media enclosure is slidably mounted to the housing for movement between the open position and the closed position.

20. The imaging system of claim 15, wherein the media enclosure is formed of a flexible material that can be positioned to block the opening to define a closed position and that can be separated from the opening to define an open position.

21. The imaging system of claim 15, wherein the entry port comprises a shoulder surface and wherein the engagement surface comprises a stopping surface adapted to engage the shoulder surface to limit extent to which the media supply is inserted into the imaging device.

22. The imaging system of claim 21, wherein the imaging system removes media from the media supply and projects the removed media from a defined exit area above the media supply and wherein the a separable part is provided that can be joined to an end of the media enclosure opposite from the device engagement surface having at least one surface that is adapted receive at least a part of the projected media.

23. The imaging system of claim 15, wherein the imaging device comprises at least one of a scanner, inkjet printer, thermal printer, pressure printer and laser printer.

24. An imaging system comprising:

a housing means said housing means having an area for storing media and an engagement surface adapted for insertion into the entry port of an imaging device;

an enclosure means joined to the housing means and movable between a position permitting access to media in the housing means and a position preventing access to media in the housing means; and an imaging means for performing imaging operations on stored media the imaging means adapted to receive said housing means, to extract stored media from the housing means and to perform said imaging operations thereon;

wherein said enclosure means is movable between the position permitting access to media in the housing means and the position preventing access to the area for storing media in the housing means when the imaging means receives the housing means; and wherein the imaging means can extract stored media when the medium enclosure is in either of the open position or the closed position.

* * * * *